US005913619A

United States Patent [19]

Lowe

[11] Patent Number: 5,913,619

[45] Date of Patent: Jun. 22, 1999

[54] MERCHANDISE MARKING TAG WITH STUB NOSE

[75] Inventor: Gary L. Lowe, Solway, Minn.

[73] Assignee: Bedford Industries, Inc., Worthington, Minn.

[21] Appl. No.: 08/795,766

[22] Filed: Feb. 6, 1997

Related U.S. Application Data

[63] Continuation-in-part of application No. 08/701,587, Aug. 22, 1996, abandoned.

[51] Int. Cl.[6] ..... G09F 3/14

[52] U.S. Cl. ..... 40/665; 40/662; 40/666; 24/18; 24/30.5 S

[58] Field of Search ..... 40/27, 305, 658, 40/662, 664, 665, 666, 908; 24/18, 30.5 S

[56] References Cited

U.S. PATENT DOCUMENTS

| | | | |
|---|---|---|---|
| D. 225,968 | 1/1973 | Crawford et al. . | |
| 566,272 | 8/1896 | Martin | 24/18 |
| 814,997 | 3/1906 | Weed | 24/563 |
| 1,021,886 | 4/1912 | Pieper et al. | 24/18 |
| 1,195,759 | 8/1916 | Wright | 40/658 X |
| 1,294,321 | 2/1919 | Stout | 24/18 |
| 1,304,417 | 5/1919 | Underwood | 40/663 |
| 1,413,626 | 4/1922 | Stout | 24/18 |
| 1,418,743 | 6/1922 | Stout | 24/18 |
| 1,485,996 | 3/1924 | Stout | 24/18 |
| 2,094,210 | 9/1937 | Graben | 40/665 |
| 2,134,002 | 10/1938 | Moat | 40/662 |
| 2,246,229 | 6/1941 | Wohlmuth . | |
| 2,438,651 | 3/1948 | Schlegel | 24/18 |
| 2,669,047 | 2/1954 | Rieger | 40/637 |
| 2,842,878 | 7/1958 | McFadden et al. | 40/662 |
| 2,847,774 | 8/1958 | Brooks | 40/666 |
| 2,981,990 | 5/1961 | Balderree, Jr. . | |
| 3,067,534 | 12/1962 | Paxton | 40/666 |
| 3,264,698 | 8/1966 | Wright . | |
| 3,270,872 | 9/1966 | Paxton . | |
| 3,822,441 | 7/1974 | Paxton . | |
| 4,379,372 | 4/1983 | Alexander et al. | 40/10 C |
| 4,519,178 | 5/1985 | Crabb, Jr. | 40/665 X |
| 4,760,624 | 8/1988 | Fish . | |
| 4,862,617 | 9/1989 | Cooke, Jr. et al. | 40/663 |
| 4,896,366 | 1/1990 | Oxman | 24/30.5 S |
| 5,167,086 | 12/1992 | Fast | 40/299 |
| 5,617,656 | 4/1997 | Ludlow et al. | 40/665 X |
| 5,697,177 | 12/1997 | Ludlow et al. | 40/665 |

FOREIGN PATENT DOCUMENTS

| | | | |
|---|---|---|---|
| 547851 | 10/1957 | Canada | 40/662 |
| 544875 | 10/1922 | France | 40/662 |
| 2678097 | 12/1992 | France | 40/666 |
| 14089 | 6/1911 | United Kingdom | 40/27 |
| 270753 | 6/1927 | United Kingdom | 40/662 |
| 879623 | 10/1961 | United Kingdom | 40/662 |
| 884536 | 12/1961 | United Kingdom | 40/662 |
| WO 94/09673 | 5/1994 | WIPO | 24/30.5 S |

*Primary Examiner*—Kenneth J. Dorner
*Assistant Examiner*—Andrea Chop
*Attorney, Agent, or Firm*—R. C. Baker & Associates, Ltd.

[57] ABSTRACT

This sheet material marking tag has a stiffly resilient header part united along a border to an information part for printed matter. A holding orifice in the header comprises a major recess divisible into substantially equal upper and lower halves. The orifice has an internal edge and the internal edge has a lower span consisting of all portions of the internal edge below the upper half of the major recess. A stub nose projects laterally from the orifice and terminates as a blunt tip. The lower edge of the nose tapers toward the border but terminates at an orifice entry slit on the lower span of the orifice internal edge. A V-shaped open mouth below the nose has an upper lip common to the lower edge of the nose and a lower lip tapering toward the orifice but terminating at a lower lip intersection along the lower edge of the nose at a location spaced from the orifice. A pinch entry channel extends as a length along the lower edge of the nose between the lower lip intersection and the orifice entry slit. Affixing the tag to an elongated component of merchandise involves easily guiding the component through the mouth and pinch entry channel into the orifice.

32 Claims, 2 Drawing Sheets

MERCHANDISE MARKING TAG WITH STUB NOSE

CROSS-REFERENCE TO RELATED APPLICATIONS

This application is a continuation-in-part of utility application, Ser. No. 08/701,587 filed Aug. 22, 1996 now abandoned.

BACKGROUND OF THE INVENTION

This invention relates to a new marking tag for merchandise. The marking tag has an information part for printed matter and a header part for fastening to an elongated component of merchandise. The header part has features useful for the purpose of guiding an elongated component of merchandise into a locked or held condition within the holding orifice of the tag. The elongated component may be a segment of a band of rubber or other material, or a vine or stem or anything else having a segment or stretch of material (i.e., an elongated component) to which the tag may be fastened or affixed.

The new tag is useful for marking a variety of horticultural products having an elongated component, including shrubs, trees, vines, and the like. One embodiment has special application for the marking of banded merchandise.

Banded merchandise has become quite common. The band may consist of rubber or twist tie or string, and may be about one or more boxes or about clumps of merchandise or about rolled or folded merchandise such as a newspaper. A wide practice is that of affixing bands about clumps of agricultural produce, especially at the time of harvesting. The addition of appropriate marking tags on such banded clumps also is desirably accomplished at or near the time of harvesting.

The reason for adding marking tags is because suppliers and mass merchandising outlets such as superstores or supermarkets have placed more and more emphasis on scannable merchandise markings as the key means to control inventory and the accuracy of processing, and they want economy and sales promotion markings.

A critical requirement of marking tags is that they stay in place on the merchandise during the several handling and processing steps in preparing the merchandise for sale to the consumer.

A further critical requirement is that of quick and successful tag affixation to merchandise with minimal worker motions. This can be a serious problem for the marking of horticultural products. Speed in affixing a marking tag to agricultural produce at the time of harvesting must be accompanied by reliability of tag affixation and avoidance of tag damage during cleaning or washing or other steps in moving the produce through marketing channels to the ultimate consumer. Easy and quick affixation without damage to the merchandise and without significant tag loss as a consequence of normal handling are requirements for the marking tags for any of a variety of merchandise items having an elongated component, especially items susceptible to being bruised. This invention provides an unexpected simplified solution to this problem.

SUMMARY OF THE INVENTION

The new marking tag is formed out of a sheet material and has an information part and a stiffly resilient header part united along a border. The information part is for printed matter, and the header part is for affixing the tag to merchandise.

The header part comprises an outer perimeter edge about it except at the border between it and the information part. The outer perimeter edge has a portion called dominant perimeter edge located opposite the border and has opposing lateral edges extending between the dominant edge and the border. A holding orifice is within the header part and comprises a major recess as the one essential feature of the orifice. This major recess is divisible into substantially equal upper and lower halves. The upper half is nearest the dominant perimeter edge. The orifice has an internal edge that defines its overall shape. The internal edge has a lower span located nearest the border. The lower span consists of all portions of the internal edge of the orifice below the upper half of the major recess. A stub nose projects laterally from the orifice to one of the lateral edges and terminates at the one lateral edge as a blunt tip. The nose has a lower edge defined by a cut line tapering from the blunt tip toward the border but terminating at an orifice entry slit on the lower span of the orifice internal edge. A V-shaped open mouth is below the nose and has an upper lip common to the lower edge of the nose. The lower lip tapers toward the orifice but terminates at a lower lip intersection along the lower edge of the nose at a location spaced from the orifice entry slit. A pinch entry channel extends as a length along the lower edge of the nose between the lower lip intersection and the orifice entry slit.

Affixing the tag to an elongated component of merchandise is easily accomplished by moving the tag to guide the elongated component between the lower edge of the nose and the lower lip of the mouth through the pinch entry channel into the orifice.

Tags of the invention may have an orifice equipped with a portion called a slotted recess (or minor recess) in addition to the major or the enlarged (or major) recess. The slotted recess extends from the enlarged (major) recess toward the border but in an angular relationship to the border such that the slotted recess angles toward the one lateral edge of the header where the nose and mouth of the header are located. This angular relationship is preferably such that the lower end of the slotted recess nearest the border is nearer to the one lateral edge of a header than the enlarged (major) recess is to that lateral edge. In tags having a slotted recess as aforenoted, the lower edge of the nose (in its taper toward the border preferably ends up forming an entry slit (into the orifice) along one side of the slotted recess portion of the orifice. The pinch entry channel for these tags generally has a relatively short length extending (i.e., as a length dimension) along the lower edge of the nose between the lower lip intersection and the orifice entry slit on the slotted recess portion of the orifice.

There are several other special features for the new marking tags of the invention, and these will become evident as this description proceeds.

DESCRIPTION OF THE PREFERRED EMBODIMENT(S)

Figure 1:
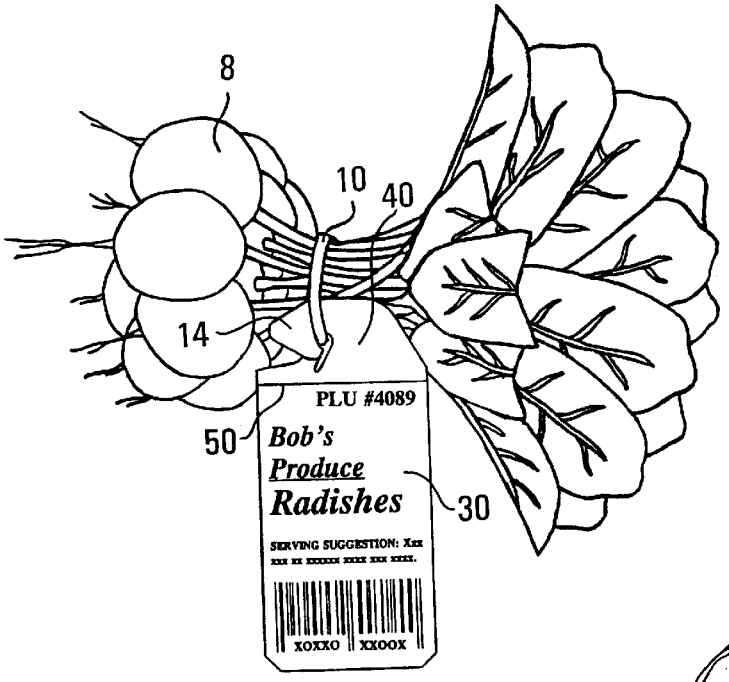
FIG. 1 is a schematic face view of one embodiment of the new marking tag of the invention on a band about a clump of vegetables, and particularly shows illustrative marking information on the information part and some basic features for the tag.
Figure 5:
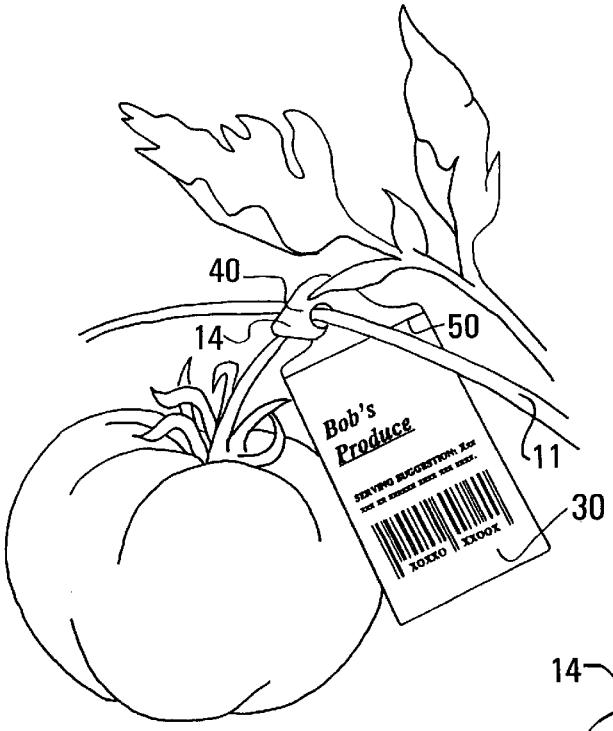
FIG. 5 is a schematic face view of the preferred embodiment of the new marking tag, shown on an elongated member (stem or vine) of a horticultural plant.

In FIG. 1, the merchandise comprises a clump of agricultural produce 8 held together by an elongated component such as a band, especially a rubber band 10 but optionally a twist tie band or other band of string-type material. In FIG. 5, the merchandise includes an elongated component 11, namely a length of a vine of a tomato plant (i.e., a product marketed for vine ripening of the tomato).

The marking tag of this invention is easily affixed to an elongated component of merchandise, whether the elongated component is formed by adding it on or to the product or is an inherent part of the product.

The new marking tag is unique in its stub nose, its V-shaped open mouth 12, and the relationship of those parts to each other as well as to the orifice and the channel into the orifice. The V-shape opening (see particularly FIGS. 2 and 6) makes the mouth 12 relatively large and deep. The projecting stub nose 14 has a relatively blunt end or tip 16. The stub nose has an upwardly sloped portion 18 and downwardly sloped portion 20 from the blunt tip.

Figure 2:
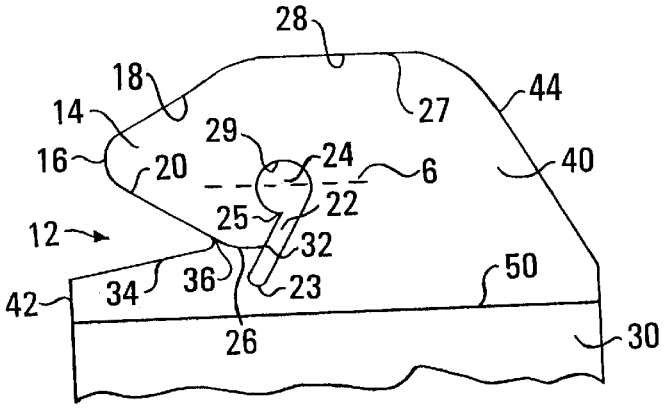
FIG. 2 is an enlarged schematic face view of the new marking tag of FIG. 1, with most of the information part broken away, and particularly shows special features of the header part.

The new tag also has a unique relationship between its orifice and the entry channel to its orifice. In FIG. 2, the orifice is made up of a slotted recess portion 22 and an enlarged or major recess portion 24. It is in that major recess 24 that an elongated component such as a band about merchandise is ultimately lodged. Getting the band (i.e., elongated component) into the enlarged major recess portion 24 illustrated in FIG. 2 involves moving the band along the lower edge 20 of the nose through a pinch entry channel 26 into the slotted recess portion 22 and then upwardly through that slotted recess portion into the enlarged recess portion 24—all with one sweeping hand movement. The downward and upward movement of the band on its way to the enlarged or major recess 24 is surprisingly easily accomplished by one sweeping hand movement. To be especially noted is that the major recess 24 of the tag of this invention has an relatively large spacing between it and the outer perimeter of the tag (which contributes to tag strength or resistance to tearing). These features and others will be better understood by reference to some further general orientation points for the tag.

Illustrative general orientation points for the tag (see FIGS. 2 and 6) include the fact that it is made out of sheet material and has an information part 30 as well as a stiffly resilient header part 40 united together along a border 50. The information part is for printed matter and may be relatively flexible as compared to the header part. Generally it is thinner than the header part, but this is not a critical requirement. The entire marking tag can be formed of a single sheet thickness, if desired. Appropriate printed indicia will generally include scannable bar codes for product identification such as those commonly called Universal Product Codes (UPC—a combination of bar code and numbers for product identification and usually also a price specification) and Product Look-Up numbers (PLU numbers). In the case of agricultural produce, the printed marking will generally also include recipes, nutritional information, serving suggestions, storage directions, origin of product information (such as produced in the U.S.A.), and everything else that could possibly help a consumer in making a purchasing decision and help retailers at check-out counters, as well as help suppliers including growers in monitoring inventory.

Figure 4:
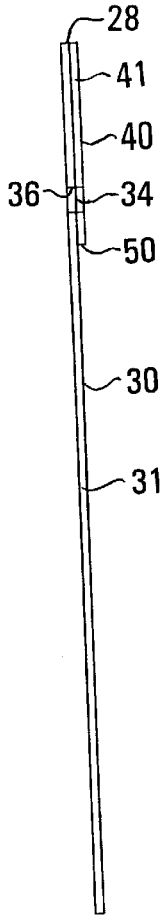
FIG. 4 is an edge view of the new tag (e.g., from the left of FIG. 2), this edge view illustrating a header formed by lamination.

The header part 40 of the marking tag has an entirely different purpose, namely that of providing a means for getting the tag of information affixed to an elongated component of merchandise (whether a band about merchandise or an integral part of the merchandise such as a stem or vine). Thus, the header, since it performs a holding function in staying on an elongated component once the tag is applied and fixed or fastened to the component, needs to be somewhat strong in character and ideally is relatively stiff but resilient to allow manipulation in getting it affixed to the component. The appropriate terminology characterizing the header is that it should be stiffly resilient in that it must be capable of some distortion in the process of getting it attached to an elongated component but yet should be relatively firm (i.e., stiff) and resiliently return to a relatively undistorted position or condition once it is affixed to the component. Polystyrene headers are rather ideal but headers of other plastics (or laminates of different materials including plastics) may be employed. The sheet material of the tag should be water resistant and not disintegrate when subjected to the water washing treatments common for banded vegetables. The varied materials useful for the sheet material of the marking tag include polyolefinic thermoplastics, polyesters, as well as still other plastics. Printable sheet material is needed for the information part 30, and this may be accomplished by applying special surface treatments as desired and well known in the industry. Printable plastic sheets may include laminates containing paper. An especially desirable printable thermoplastic sheet is available commercially under the trademark "TESLIN" from PPG Industries of Pittsburgh, Pennsylvania. Extremely thin sheets of "TESLIN" may form an information part 30 for the new marking tag, and the header part 40 may be formed by laminating polystyrene or other stiffer and thicker plastic sheet material to the "TESLIN". A composite structure of this type (see FIG. 4) has an ideally thin and printable sheet material 31 for the information part 30 and a nicely stiffly resilient header part 40 formed by laminating the plastic sheet 41 to the thin sheet 31. The lower edge of the laminated sheet 41 defines the border 50 between the parts in FIG. 4.

As for the printing on the information part, or for that matter, any optional printing on the header part, any of a variety of commercially available inks compatible and accepted on the sheet to be printed may be employed; and water-insoluble properties as well as adherence properties may be gained by any of a multitude of known commercial techniques readily understood in the art.

Figure 6:
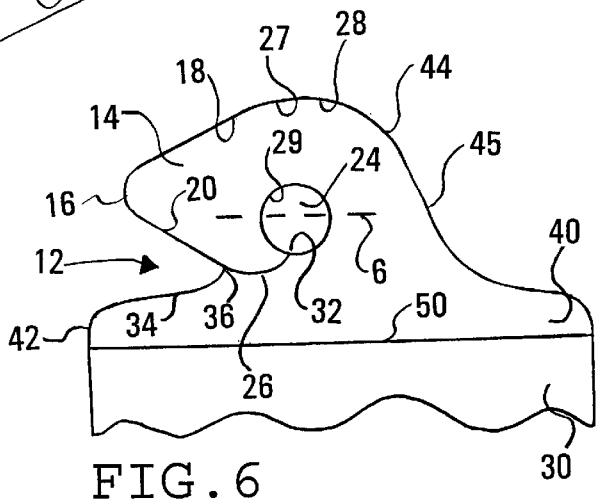
FIG. 6 is an enlarged schematic face view of the preferred embodiment of FIG. 5, with most of the information part broken away.

Continuing with general orientation points, a first principle is to recognize that the header part 40 for locking or fastening on an elongated component of merchandise has an outer perimeter edge 28 about all portions of the header part except the border 50. Those perimeter edge portions are identified as the dominant perimeter edge 27, which is opposite the border 50 and the opposing lateral edges 42, 44. The dominant or upper edge portion 27 of the overall outer perimeter edge 28 is spaced from and generally (but not always) somewhat parallel to the border 50 between the header and information parts. The opposing lateral edge portions 42, 44 extend between the uppermost dominant perimeter edge 27 and the border 50. The lateral perimeter edges 42, 44 are not necessarily straight and may include special features. For example, the left lateral perimeter edge 42 is illustrated in all figures except FIG. 4 as having a mouth 12 and outer surfaces 16, 18, and 20 that shape the stub nose 14. The right lateral edge 44 is illustrated in FIG. 2 as having a gradual slope toward the border 50, whereas the right lateral edge 44 is illustrated in FIG. 6 as having an inward concave curvature 45 (especially useful as a concavity for receiving the tip of a person's index finger to assist easy affixation of the tag on an elongated component such as a stem or vine).

Between the opposing lateral edge portions 42 and 44, and between the dominant edge or upper edge 27 of the outer perimeter edge 28 and the border 50, are several special features of the new marking tag of this invention.

The holding orifice within the header part 40 comprises the major recess 24, which sometimes is called the enlarged recess.

Figure 3:
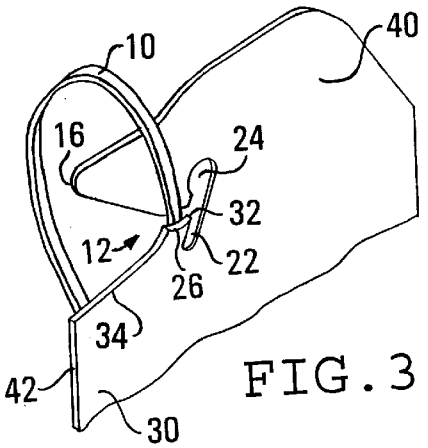
FIG. 3 is a perspective view of a fragment of the header part of the tag of FIG. 1 and illustrates displacement of the stub nose from the plane of the tag in the step of slipping the tag (i.e., the header part of the tag) into a locking or fastened condition on a band.

Referring particularly to FIGS. 1–3, the orifice features for the embodiment of the invention specially designed for receiving a band (but useful also for receiving an elongated component) will first be discussed. For this embodiment, the orifice comprises a slotted portion 22 as well as the enlarged (major) recess portion 24. The enlarged or major recess portion 24 is spaced from the upper dominant perimeter edge 27 but is nearer to that dominant edge 27 than the slotted recess portion 22 is. The slotted portion 22 extends in an angular relationship from the enlarged major recess portion 24 toward the border 50. This angular relationship is such that the end 23 of the slotted recess nearest the border 50 is almost always nearer one lateral edge 42 of the header than the enlarged recess portion 24 is to that lateral edge 42. The slotted recess 22 extends more or less as a shaft in an angularly sloping direction with respect to the relatively straight border 50 and extends angularly with respect to the overall extent of the one lateral edge 42. Further, the slotted recess merges with the enlarged (major) recess 24.

The length of the slotted recess 22 is preferably at least three or four times its width. Its width is capable of accommodating the conventional or popular sizes of elastomeric bands employed for banding merchandise. Such bands (commonly called rubber bands) generally have a cross-section size no smaller than about 1/32 inch in perpendicular directions and frequently will have cross sections of at least 1/16 inch in perpendicular directions. Rubber bands of greater cross-sectional dimension than 1/16 inch in perpendicular directions can be used, although those greater than 1/8 inch or greater than 1/4 inch in each perpendicular direction are generally unnecessarily strong and needlessly expensive to employ for the banding of many items of merchandise. Even so, rubber bands having cross sections as small as 1/32 or 1/16 inch in one direction and a perpendicular size of 1/8 inch or even 1/4 inch or more are sometimes employed. The cross-sectional size of useful rubber bands dictates that the ideal slotted portion for the orifice should have a width greater than about 1/32 inch (0.08 cm) but for the most part no greater than about 1/8 inch (approximately 0.32 cm). Ideally, the rubber band about merchandise should interact with the slot to more or less frictionally resist exit from the enlarged (major) recess portion 24 down through the slot, although the degree of frictional resistance may vary.

The enlarged or major recess 24 of the orifice in FIGS. 1–3 is preferably at least 50 percent greater in its perpendicular dimensions or diameter than the width of the slot portion 22, and generally is even larger, such as a size having perpendicular dimensions (or diameter) two or three times the width of the slot portion 22. For the most part, the major recess should have perpendicular (or diameter) dimensions of at least 2 or 3 millimeters. An enlarged or major recess 24 having perpendicular dimensions greater than three times the width of the slot 22 is seen as unnecessarily large and in fact may be undesirable for use on banded merchandise, but not undesirable for embodiments of the invention for other uses such as on small trees, etc. In fact, the only reason for not desiring larger major recesses 24 for banded merchandise is because the larger recesses for the tags tend to create the problem of needlessly weakening a header of reasonable small size. Greatly enlarged orifices (for tags of relatively small size) tend to reduce the body of material (in a relative sense) between the orifice 24 and all parts of the outer perimeter edge 28. Larger tags, as for trees or the like, may have major orifices with perpendicular dimensions (or diameters) as great as 2 or 3 centimeters or more.

The ideal design for a slot-type recess is one where the slotted portion 22 merges with a circularly configured enlarged major recess portion 24 at a tangent to the enlarged portion. This in turn equips the enlarged or major recess with a pointed corner or hook 25 (see FIG. 2), which assists in obstructing escape of a band lodged in the enlarged recess.

Figure 7:
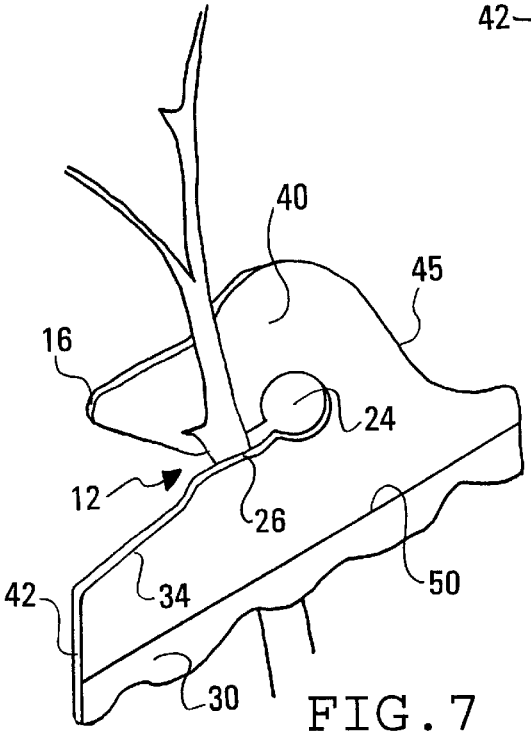
FIG. 7 is a perspective view of a fragment of the tag of FIG. 5 and illustrates a manner of applying the tag to an elongated member.

In all embodiments, the orifice always has a portion called the major recess 24. In the embodiment of FIGS. 5–7, the orifice literally consists of the major recess 24 without the slotted recess 22. In terms of the breadth of the invention, the orifice may or may not be equipped with one or more slots or arm extensions in various directions from the major recess. The enlarged or major recess is capable of the function of holding an elongated component in a manner resistant to dislodgment from the orifice. Importantly, the major recess has a degree of symmetry sufficient for it to be characterized as divisible into upper and lower halves of substantially equal area. Thus, while perfect symmetry is not required, the resemblance of symmetry contributes to ready appreciation of an imaginary halving line 6 represented by a dashed line in FIGS. 2 and 6. The upper half of the major recess 24 is thus nearest the dominant perimeter edge portion 27 and the lower half is nearest the border 50. A still further feature of the orifice of all embodiments is the internal edge 29 that follows and defines the overall shape of the orifice. In FIG. 2, the internal edge 29 extends into the slot 22 (and thus defines it) as well as about the major recess 24, whereas in FIG. 6, the internal edge 29 defines the perimeter of only major recess 24 (because the orifice in FIG. 6 consists of the major recess 24 per se). The upper span of the internal edge 29 (i.e., the portion of the internal edge 29 above the imaginary halving line 6) is nearest the dominant perimeter portion 27, whereas the lower span of internal edge 29 (i.e., below the halving line 6) is nearest the border 50. The reference to the internal edge of the lower span is always a reference to the internal edge 29 lying below the halving line 6. In the embodiment illustrated in FIG. 2, the lower span includes the internal edge of the slotted recess 22 as well as the lower half of the internal edge of the major recess 24. In short, the lower span of the orifice internal edge 29 consists of all portions of the orifice internal edge 29 below the upper half of the major recess. A critical feature of the invention is that the orifice entry slit 32 is always on the lower span of the orifice internal edge 29; it is always at a location other than on the portions of the orifice internal edge 29 above the halving line 6. Also of note is the fact that the entry slit 32 is in an angular relationship to the internal edge 29 of the orifice. The slit 32 projects outwardly from the internal edge 29, and the angular relationship is such that the entry slit 32 at its last millimeter next to the internal edge 29 is approximately or near perpendicular to the internal edge 29 or at least not angling more than about 50 degrees to the internal edge.

Also, in all embodiments, the stub nose 14 projects laterally from the enlarged (major) recess portion 24 of the orifice toward one lateral edge portion of the header. (The one lateral edge 42 in the embodiment of FIGS. 1–3 is the lateral edge toward which the lowest end 23 (i.e., the end nearest the border) of the slotted recess 22 projects.)

The nose 14 terminates in a blunt tip 16, and the tip in all embodiments is preferably more distance from the border than the most distant part of the orifice is from the border. Further, the nose tip 16 is nicely spaced from the orifice 24 but recessed inwardly from the most laterally outward portion of the one lateral edge 42. This is significant. Affixing this tag to an elongated component does not require the step of sliding the elongated component along the lateral edge 42 of the header, and does not require sliding the lateral edge on the component to cause the component to enter the V-shaped open mouth 12. Instead, the blunt tipped stub nose per se is designed to latch onto and cause movement of the elongated component into a locked or held condition within the orifice of this improved tag. The nose has an upper edge 18, which is most remote from the border, and this upper edge 18 is also more remote from the border than the enlarged or major recess 24 of the orifice is from the border 50. This upper edge 18 slopes upwardly from the blunt tip 16 and merges into the uppermost dominant perimeter edge 27 of the composite total outer perimeter edge 28 of the header. The lower edge 20 of the nose is defined by a cut line that tapers from the blunt tip 16 in a downward manner toward the border and away from the one lateral edge 42 toward which the blunt tip 16 of the nose projects. The taper of the lower edge 20 of the nose is not just toward the border 50. It is also a taper that terminates at an orifice entry slit 32 on the lower span of the orifice internal edge 29. The taper is toward a location under the halving line 6 of the major recess 24. In effect, for the embodiment having the slotted recess 22, the taper of the lower edge of the nose is toward or at least ends at the slotted recess portion 22. Further, in the embodiment of FIGS. 1–3, the taper of the lower edge 20 can be characterized as terminating at a location 32 (i.e., an orifice entry slit) along one side of the slotted recess portion 22 of the orifice, preferably with a slight upward curvature away from the border 50 as the lower edge 20 of the cut line defining the nose terminates on the side of the slotted recess portion of the orifice. The side of the slotted recess 22 where the lower edge taper of the nose terminates is nearer the tip 16 of the nose than the other side of the slot 22.

A V-shaped mouth 12 is an important feature of all embodiments of the tag. This mouth extends along the one lateral edge 42 of the header at a location below the nose 14. In fact, the mouth has an upper lip 20 common to the cut line for the lower edge 20 of the nose and a lower lip 34 tapering from the one lateral edge 42 of the header in an upward direction away from the border 50 and also away from the one lateral edge 42. The taper of the lower lip 34 of the V-shaped open mouth is such as to extend to and intersect the taper of the lower edge 20 of the nose. While the lines of taper for these elements need not be perfectly straight (and may be gradually curved lines), the angular relationship (in an overall sense) between the taper of the lower lip 34 and the taper of lower edge 20 (i.e., upper lip of the mouth) is between about 20 degrees and 80 degrees. A large open mouth is most useful. The intersection 36 of the lower lip 20 with the lower edge of the nose is called a "lower lip intersection." This intersection is along the lower edge of the nose at a location spaced from the orifice 22, 24 in all respects. Most preferably, the intersection 36 per se for the lower lip 34 with the lower edge 20 of the nose is substantially perpendicular or near perpendicular, i.e., at an angle at least within about 30 degrees from perpendicular. The angle is formed by the ending curvature for the lower lip 34 and is measured at the open mouth side of the lower lip intersection. A large and deep mouth resulting from the V-shape is an important functional feature for easy elongated component (e.g., band, stem, vine, etc.) entry and affixation performance for this new tag.

Between the lower lip intersection 36 and the orifice entry slit 32 is the pinch entry channel 26. (In the embodiments having a special slotted recess portion 22 in addition to the major enlarged recess portion 24, the pinch entry channel is between the lower lip intersection 36 and the slotted recess portion 22.) This pinch entry channel is common to the cut line for the lower edge 20 of the nose at its portion between the lower lip intersection 36 and the orifice entry slit 32. The length of this channel between the lower lip intersection and pinch entry slit 32 can be relatively short (but is preferably at least 2 or 3 millimeters in length), and ideally the length is no greater than about the diameter of the enlarged (major) recess portion 24 or maximum perpendicular direction for the major recess 24. The length of the pinch entry channel 26 may be somewhat larger (i.e., longer) as an option, but it should never exceed half the length of the tapering cut line for the lower edge 20 of the nose from the tip 16 of the nose to the entry of the cut line (i.e., the orifice entry slit) into the slotted recess portion 22. (For the embodiment of FIGS. 1–3, the length also preferably never should be greater than three or possibly four times the width of the slotted recess portion 22 of the orifice.) There are other preferred relationships between features of the header part. For one thing, the space between the enlarged recess portion 24 (i.e., the major recess portion) and the outer dominant portion 27 of the perimeter edge 28 (i.e., the portion of the perimeter most remote from the border 50) should be more than one and one-half times the length of the pinch entry channel 26 and should be at least as great as two-thirds of the space between the blunt tip 16 of the nose and the enlarged recess portion 24 of the orifice. In fact, the space between the enlarged recess portion 24 and the dominant edge portion 27 of the outer perimeter edge 28 ideally approximates the space between the blunt tip 16 of the nose and the enlarged recess portion 24, or comes close to approaching or approximating it. In any event, the space between the enlarged or major recess portion 24 and the dominant edge portion 27 of the outer perimeter edge 28 should be at least as great as (or more than two-thirds as great as) the space between the blunt tip of the nose and the enlarged or major recess portion 24.

The principal relationships for the aforenoted features for the header contribute to simple affixation of the marking tag to a band about merchandise or to a vine or stem or any other elongated component of merchandise. In fact, the relationships make it very easy to accomplish affixation with minimal energy by a single sweeping hand movement that causes the elongated component to have a particularly special path as it moves into the major recess portion of the orifice.

Specifically, the sweeping movement using the blunt tip 16 of the nose to hook on an elongated merchandise component causes the component to be downwardly guided along the lower edge 20 of the nose and then through the pinch entry channel 26 to the orifice. When the orifice entry slit 32 is on the slotted recess portion 22 of the orifice, the continuation of the single sweeping movement causes the elongated component (e.g., band material) to be upwardly guided along the slotted recess portion 22 into the enlarged or major recess portion 24 of the orifice. The elongated component ultimately resides in the major recess 24 in a condition highly resistant to dislodgment, and a condition that contributes to easy handling of the tag as a scannable marker without causing it to be disruptively torn from the merchandise. The significant bulk of material between the enlarged recess portion 24 and the dominant portion 27 of the outer perimeter edge 28, and also the bulk between the major recess portion 24 and the blunt tip 16 of the nose, are surprisingly unobtrusive during the step of affixing the marker to an elongated component of merchandise and yet are very functional to obstruct tearing of the tag from its affixation to merchandise during rather severe processing conditions (e.g., as experienced for some agricultural produce). The most ideal enlarged or major recess portion is circular or at least rounded in the lengthwise direction of its internal edge 29. Such a rounded edge provides no starting corner and thus little opportunity for the development of a tear, even when the tag is strongly tugged in a direction away from a band or other elongated component.

To be noted is that the pinch entry channel 26 is simply a cut line separating the lower edge 20 of the nose from the body of the header 40 below the lower edge 20. The pinch entry channel 26 in the nature of a slit does get distorted open (see FIGS. 3 and 7) as an elongated component passes through it; but once the component passes into the orifice, the pinch slit portion 26 substantially recloses because of the stiffly resilient character of the header material.

In the embodiment of FIGS. 1–3, it is conceivable that an operator or worker might fail to cause a band to slide up the slot 22 into the enlarged recess portion 24 in one sweeping hand motion. Nevertheless, the fact that the band might sometimes end up in the slotted recess portion 22 (at a minimum) will cause the band on any pulling action (on the tag) to move into the larger diameter or major portion 24 of the orifice where it is restrained or held resistant to dislodgment and is assisted in that result by the pointed corner 25 of the orifice. If the tag were then to slip upward (or the band 10 to slip downward) to place the band in the narrow slot or slotted recess 22 of the orifice, the likelihood is that the band would pass beyond the entry point 32 for the pinch entry channel into the lower end 23 of the slotted recess portion. The reason for this is because the pinch entry channel in all embodiments is not one that is easily reopened for full easy movement of an elongated component through it in an outward direction away from any part of the orifice.

Generally the header 40 of the marking tag should be smaller in size than the information part. For example, a versatile header 40 may have a dimension between the border and outer perimeter edge of only about 2 cm and a dimension between the lateral edges of only about 3 cm. But headers considerably in excess of this size, even into the 10 or 15 cm range in one or more directions, also are useful. In contrast, the information part of the tag is generally quite large and it almost always will be larger than the header area. An illustrative information part will rarely be less than 2 cm by 3 cm, and frequently will be of a size of at least about 3 or 4 cm in each perpendicular direction up to possibly sizes in excess of 8 or 10 or 12 or even more centimeters in one or both perpendicular directions. Sizes varying from 2, 3, or 4 cm up to about 20 cm or more may be employed.

Usually the header part of the sheet material will have a thickness of at least about 0.2 or 0.3 mm, or about 10 or 12 mils (0.010 or 0.012 inch) to give the stiff resilient feature for it. For the most part, headers in excess of about 1.5 mm or about 60 mil are unnecessarily thick and too expensive (because of the large quantity of material employed) for the particular markets that should be highly interested in marking tags of the character taught by this invention. The thickness for the information part of the tags may equal that of the header part but for the most part is preferably thinner than the header and may be as thin as 0.1 mm (or 2 or 3 mils; 0.002 or 0.003 inches) and preferably no greater than about 0.4 or 0.6 mm, although thicker information parts equalling the thickness of the header can be used.

The finger gripping of the new marking tag for latching it onto a band about produce or other merchandise is preferably accomplished by finger gripping the header part along the border at a location between the orifice and the lateral edge of the header opposite the one lateral edge to which the nose is pointed. Preferably, at least for the embodiments having the concavity 45 in the lateral edge opposite the blunt nose 16, the end of a person's index finger is applied to concavity 45 while the person's thumb and middle finger pinch opposite sides of the header. The three point handling of the header makes it relatively easy to distend one side of the pinch entry channel 26 from the plane of the other side of it as the tag is affixed to an elongated component such as a vine or stem.

Noteworthy is the fact that the blunt tip 16 of the nose is recessed slightly inward from the most lateral portions of the lateral edge 42. This feature plus the taper 20 of the lower edge of the nose (and resulting bulk or body for the stub nose) helps to protect the stub nose from unwanted bending or weakness in use.

The outer perimeter edge most remote from and substantially or generally parallel to the border is called the dominant outer perimeter edge to distinguish it from the opposing lateral edges, which may be called subordinate perimeter edges.

There may be variations of structure within planar sheet material useful for practice of the invention, and it is to be recognized that the plastics employed may include a great variety. Any of a variety of known adhesives and surface treatments may be employed to enhance performance features. Rotary punching and rotary die cutting are preferred techniques for creating the features of the new marking tag.

Those skilled in the art will readily recognize that the invention may be embodied in still other forms than the forms specifically illustrated without departing from the spirit or essential characteristics of the invention; and all variations that come within the scope and meaning of the claims, and the range of equivalency for the claims, are intended to be embraced thereby.

That which is claimed is:

1. A sheet material merchandise marking tag having a stiffly resilient header part united along a border to an information part for printed matter, said header part comprising an outer perimeter edge about said header part except at said border, said outer perimeter edge having a dominant perimeter edge located opposite said border and having opposing lateral edges extending between said dominant edge and said border, a holding orifice within said header part, said orifice comprising a major recess divisible into substantially equal upper and lower halves, said upper half being nearest said dominant perimeter edge, said orifice having an internal edge defining its overall shape, said internal edge having a lower span located nearest said border and consisting of all portions of said orifice internal edge below said upper half of said major recess, a stub nose projecting laterally from said orifice to one said lateral edge and terminating at said one said lateral edge as a blunt tip, said nose having a lower edge defined by a cut line tapering from said blunt tip in an inward direction away from said one lateral edge and toward said border but terminating at an orifice entry slit on said lower span of said orifice internal edge, a V-shaped open mouth below said nose, said mouth having an upper lip common to the lower edge of said nose and a lower lip tapering away from said one lateral edge toward the orifice but terminating at a lower lip intersection along the lower edge of said nose at a location spaced from said orifice entry slit, and a pinch entry channel extending as a length along the lower edge of the nose between the lower lip intersection and said orifice entry slit, said length of said pinch entry channel being less than the distance between said lower lip intersection and the blunt tip of said nose, whereby affixing the tag to an elongated component of merchandise is easily accomplished by moving the tag to guide the elongated component between the lower edge of the nose and the lower lip of said mouth through the pinch entry channel into the orifice.

2. The tag of claim 1 wherein said internal edge of said major recess is substantially rounded.

3. The tag of claim 1 wherein said internal edge of said major recess has a generally circular configuration.

4. The tag of claim 1 wherein said orifice consists of said major recess.

5. The tag of claim 1 wherein said upper lip and lower lip of said V-shaped open mouth are in a angular relationship between about 20 degrees and 80 degrees.

6. The tag of claim 5 wherein said lower lip intersection formed by said lower lip intersecting said lower edge of said nose does not deviate more than about 30 degrees from perpendicular.

7. The tag of claim 1 wherein said blunt tip of said stub nose is more distant from said border than said major recess.

8. The tag of claim 1 wherein the space between said major recess and said dominant perimeter edge is at least as great as two-thirds of the space between said major recess and said blunt tip of said nose.

9. The tag of claim 1 wherein said intersection of said lower lip along the lower edge of said nose comprises an end curvature of said lower lip to intersect said lower edge of said nose at an angle within about 30 degrees from perpendicular to said lower edge of said nose.

10. The tag of claim 1 wherein said pinch entry channel is at an angular relationship to the internal edge of said orifice, said angular relationship being within 50 degrees from perpendicular to said internal edge.

11. A sheet material merchandise marking tag having an outer perimeter defining the shape of said tag and within which is a stiffly resilient tag header part united along a border to a tag information part for printed matter, said header part being for fastening to an elongated component of merchandise and comprising a holding orifice having an enlarged recess portion and a slotted recess portion extending from the enlarged recess portion toward the border but in an angular relationship to the border such that the slotted recess angles toward but does not reach one lateral edge of said header, said slotted recess being entirely interior to and not extending to the outer perimeter of said tag, a stub nose projecting laterally from the orifice toward said one lateral edge and terminating at a blunt tip, said nose having a lower edge defined by a cut line tapering from said blunt tip in an inward direction away from said one lateral edge and toward the border but terminating at the slotted recess portion of the orifice, a V-shaped open mouth below the nose, said mouth having an upper lip common to the lower edge of the nose and a lower lip tapering toward the orifice but terminating at a lower lip intersection along the lower edge of the nose at a location spaced from the orifice, said intersection of said lower lip along the lower edge of said nose being formed by an end curvature of said lower lip to intersect said lower edge of said nose at an angle within about 30 degrees from perpendicular to said lower edge of said nose, and a pinch entry channel extending as a length along the lower edge of the nose between the lower lip intersection and the slotted recess portion and entering said slotted recess portion along a side thereof, whereby affixing the tag to an elongated component of merchandise causes the elongated component to be downwardly guided along the lower edge of the nose through the pinch entry channel to the slotted recess portion of the orifice and then upwardly guided along the slotted recess portion into the enlarged recess portion of the orifice.

12. The tag of claim 11 wherein said enlarged recess portion has a circular configuration.

13. The tag of claim 12 wherein said slotted recess portion extends tangentially from said circular configuration.

14. The tag of claim 12 wherein said circular configuration has a diameter at least twice the width of said slotted recess portion.

15. The tag of claim 12 having a tangential relationship between the slotted recess portion and the circular configuration for the enlarged recess portion and wherein said tangential relationship creates a hook edge in said circular configuration and said hook edge functions to obstruct movement of an elongated component from said circular configuration into said slotted recess portion.

16. The tag of claim 11 wherein the end of said slotted recess portion nearest said border is nearer said one lateral edge than any part of said enlarged recess portion.

17. The tag of claim 11 wherein said blunt tip of said stub nose is more distant from said border than any part of said orifice.

18. The tag of claim 11 wherein the length of said pinch entry channel between said lower lip intersection and said orifice is less than the distance between said lower lip intersection and the blunt tip of said nose.

19. A marking tag in the form of a sheet material having an information part and a stiffly resilient header part united along a border, said information part being for printed matter, said header part being for locking on an elongated component of merchandise and having a dominant outer perimeter edge opposite said border and having opposing lateral edges extending between said dominant perimeter edge and said border, said header part being characterized by the following combination of features:

i) a holding orifice between said dominant perimeter edge and said border, said holding orifice being for receiving an elongated component and comprising a slotted recess portion and an enlarged recess portion, said enlarged recess portion being spaced from said dominant perimeter edge but nearer to said dominant perimeter edge than said slotted recess portion, said slotted recess portion extending from said enlarged recess portion toward said border in an angular relationship to said border, said angular relationship being such that the end of said slotted recess nearest said border is nearer one lateral edge of said header than said enlarged recess portion of said orifice, ii) a stub nose projecting laterally from said orifice toward said one lateral edge of said header and terminating at a blunt tip, said blunt tip being spaced from said orifice and recessed inwardly from the most laterally outward portion of said one lateral edge, said nose having an upper edge sloping upwardly from said blunt tip and a lower edge defined by a cut line tapering from said blunt tip toward said border but terminating at a location on one side of the slotted recess portion of said orifice, iii) a V-shaped open mouth on said one lateral edge of said header, said mouth having an upper lip common to said lower edge of said nose and a lower lip tapering away from said one lateral edge to form a lower lip intersection along said lower edge of said nose at a location spaced from said orifice, and iv) a pinch entry channel extending as a length along said lower edge of said nose between said lower lip intersection and said slotted recess portion and entering said slotted recess portion along a side thereof, said length of said pinch entry channel being less than the distance between said lower lip intersection and the blunt tip of said nose, v) said space between said enlarged recess portion and said dominant perimeter edge being more than one and one-half times the length of said pinch entry channel and being more than two-thirds as great as the space between said blunt tip of said stub nose and said enlarged recess portion of said orifice, the relationship of said features of said header part being such that affixing said marking tag to an elongated component of merchandise is easily accomplished by a single sweeping hand movement that causes said elongated component to be downwardly guided along the lower edge of said nose through said pinch entry channel to said slotted recess portion of said orifice and then along said slotted recess portion into said enlarged recess portion of said orifice where said elongated component resides resistant to dislodgment.

20. A sheet material merchandise marking tag having a header part above an information part, said header part having a dominant perimeter edge located opposite said information part and having opposing lateral edges extending from said dominant edge toward said information part, a holding orifice within said header part, said orifice comprising a major recess divisible into substantially equal upper and lower halves, said upper half being nearest said dominant perimeter edge, said orifice having an internal edge defining its overall shape, said internal edge having a lower span located nearest said information part and consisting of all portions of said orifice internal edge below said upper half of said major recess, a stub nose projecting in a lateral direction from said orifice to one said lateral edge and terminating at said one said lateral edge as a blunt tip, said nose having a lower edge defined by a cut line tapering from said blunt tip in an inward direction away from said one lateral edge and toward said information part but terminating at an orifice entry slit on said lower span of said orifice internal edge, a V-shaped open mouth below said nose, said mouth having an upper lip common to the lower edge of said nose and a lower lip tapering away from said one lateral edge toward the orifice but terminating at a lower lip intersection along the lower edge of said nose at a location spaced from said orifice entry slit, and a pinch entry channel extending as a length along the lower edge of the nose between the lower lip intersection and said orifice entry slit, said length of said pinch entry channel being less than the distance between said lower lip intersection and the blunt tip of said nose, whereby affixing the tag to an elongated component of merchandise is easily accomplished by moving the tag to guide the elongated component between the lower edge of the nose and the lower lip of said mouth through the pinch entry channel into the orifice.

21. The tag of claim 20 wherein said header part is stiffly resilient.

22. The tag of claim 20 wherein said header part is united along a border to said information part.

23. The tag of claim 20 wherein said internal edge of said major recess is substantially rounded.

24. The tag of claim 20 wherein said orifice consists of said major recess.

25. The tag of claim 20 wherein said upper lip and lower lip of said V-shaped open mouth are in an overall angular relationship between about 20 degrees and 80 degrees.

26. The tag of claim 20 wherein said lower lip intersection formed by said lower lip intersecting said lower edge of said nose does not deviate more than about 30 degrees from perpendicular.

27. The tag of claim 20 wherein said blunt tip of said stub nose is more distant from said information part than said major recess.

28. The tag of claim 20 wherein the space between said major recess and said dominant perimeter edge is at least as great as two-thirds of the space between said major recess and said blunt tip of said nose.

29. The tag of claim 20 wherein said intersection of said lower lip along the lower edge of said nose comprises an end curvature of said lower lip to intersect said lower edge of said nose at an angle within about 30 degrees from perpendicular to said lower edge of said nose.

30. The tag of claims 20 wherein said pinch entry channel is at an angular relationship to the internal edge of said orifice, said angular relationship being within 50 degrees from perpendicular to said internal edge.

31. A sheet material merchandise marking tag having a header part above an information part, said header part having a dominant perimeter edge located opposite said information part and having opposing lateral edges extending from said dominant edge toward said information part, a holding orifice within said header part, said orifice having an internal edge defining its overall shape, a stub nose projecting in a lateral direction from said orifice to one said lateral edge and terminating at said one said lateral edge as a blunt tip, said nose having a lower edge defined by a cut line tapering from said blunt tip in an inward direction away from said one lateral edge and toward said information part but terminating at an orifice entry slit on said orifice internal edge, a V-shaped open mouth below said nose, said mouth having an upper lip common to the lower edge of said nose and a lower lip tapering away from said one lateral edge toward the orifice but terminating at a lower lip intersection along the lower edge of said nose at a location spaced from said orifice entry slit, and a pinch entry channel extending as a length along the lower edge of the nose between the lower lip intersection and said orifice entry slit, said length of said pinch entry channel being less than the distance between said lower lip intersection and the blunt tip of said nose, whereby affixing the tag to an elongated component of merchandise is easily accomplished by moving the tag to guide the elongated component between the lower edge of the nose and the lower lip of said mouth through the pinch entry channel into the orifice.

32. The tag of claim 31 wherein said intersection of said lower lip along the lower edge of said nose comprises an end curvature of said lower lip to intersect said lower edge of said nose at an angle within about 30 degrees from perpendicular to said lower edge of said nose.

* * * * *